United States Patent [19]

Fitjer

[11] Patent Number: 4,982,838

[45] Date of Patent: Jan. 8, 1991

[54] DISPOSABLE MASCARA TESTER

[75] Inventor: Holger Fitjer, Ansbach, Fed. Rep. of Germany

[73] Assignee: Georg Karl geka-brush GmbH, Bechhofen-Waizendorf, Fed. Rep. of Germany

[21] Appl. No.: 359,197

[22] Filed: May 31, 1989

[51] Int. Cl.[5] ..... B65D 81/24

[52] U.S. Cl. ..... 206/209; 206/361; 206/581; 206/823; 132/317; 132/318

[58] Field of Search ..... 206/38, 209, 361, 363, 206/370, 438, 581, 601, 823; 132/317, 318

[56] References Cited

U.S. PATENT DOCUMENTS

| | | | |
|---|---|---|---|
| 2,990,834 | 7/1961 | Amen | 132/317 |
| 3,282,114 | 11/1966 | Pell | 206/363 |
| 3,431,919 | 3/1969 | Van Der Bosch | 132/317 |
| 3,690,448 | 9/1972 | Switzer | 206/361 |
| 4,175,008 | 11/1979 | White | 206/209 |
| 4,492,305 | 1/1985 | Avery | 206/361 |
| 4,711,354 | 12/1987 | Bennett | 206/581 |
| 4,815,608 | 5/1989 | Silberberg | 206/581 |

*Primary Examiner*—David T. Fidei

*Attorney, Agent, or Firm*—Jordan and Hamburg

[57] ABSTRACT

A disposable mascara tester for the hygienic testing of cosmetic materials includes a stem, an applicator attached to the stem, a stripper on the stem, and a plastic covering disposed about the stem, the stripper and the applicator. The plastic covering is sealed to thereby define a sealed capsule in which the stem, the stripper and the applicator are encapsulated. The applicator is operable to effect application of a sample of cosmetic material within the sealed capsule upon unsealing of the plastic covering.

10 Claims, 1 Drawing Sheet

DISPOSABLE MASCARA TESTER

BACKGROUND OF THE INVENTION

The invention relates to a disposable test unit for the hygienic testing of cosmetic materials in liquid, paste or powder form with a means for their application in the form of an applicator fastened to a stem.

In view of the ever increasing number of cosmetic preparations such as mascara, eye shadow, lip gloss, face powder and the like, there has long been a need for prospective purchasers to test them before buying them, either to determine whether the desired color shade matches their character and their make-up, or to determine whether the chemical composition of the preparation is compatible with their skin. Keeping on hand a normal cosmetic unit which could be used by the customer, as initially practiced, had for one thing the disadvantage that after a relatively short time the test tables became greatly soiled. Added to that are the hygienic and health risks created by the fact that different customers are using the applicator previously used by another customer. For these reasons regulations were recently established in the United States prohibiting the repeated use of an applicator for test purposes in this manner.

The problem, however, is still not solved by using application units in which the actual applicator is a replaceable throw-away which, after one use by a customer, is ejected and can be replaced with an unused, fresh applicator for the next customer.

That is, the difficulty still exists that a great number of bottles and containers must be kept on hand into which the customer then dips the applicator in order to test the desired preparation. The unhygienic assemblage of such containers, resulting very soon in a greatly soiled test table, is still there.

The invention therefore is addressed to the problem of creating a disposable mascara tester which will reliably eliminate the above-described difficulties and at the same time avoid the problem that less frequently used applicators dry out uselessly and at considerable cost or otherwise lose their proper consistency, either because someone fails to close them correctly, or because when left lying for a long time before the next use the substance no longer has the consistency which it actually should have.

SUMMARY OF THE INVENTION

To solve this problem, provision is made in accordance with the invention for the applicator, together with a a stripper displaceable on the stem, to be heat-sealed in a preferably transparent plastic bag such that the applicator extends into a tightly sealed capsule containing a sample of the cosmetic substance.

With a disposable mascara tester in accordance with the invention all problems connected with the testing of cosmetic substances are simply and reliably solved. Not only is the maintaining of such disposable test units each containing the cosmetic material within them substantially more hygienic than the use of applicators with removable disposable tips, but also the units are considerably easier to manufacture and hence also much less expensive. This latter point, however, is of extremely great importance considering that a cosmetics manufacturer has to provide dozens of different test samples—even possibly hundreds of them if all shades of color are included—at every location where his products are sold, and has to provide them of course in great numbers. Another great advantage of the disposable mascara tester in accordance with the invention is to be seen in the fact that rarely used cosmetics do not complicate the test program, since they do not have to be replaced for very long periods of time. The air-tight sealing of the sample in the test unit enables it to be tested reliably even after a very long time.

To seal the reservoir chamber off from the chamber containing the stem and the stripper which is pulled forward over the applicator after tearing open the bag, thus assuring, as in conventional cosmetic units, that the desired amount of the substance will be dispensed to the bristles or to the sponge of the applicator, a transverse welded seam running across the stem can be provided in the simplest case.

Especially in the case of the more fluid cosmetics in which even slight gaps between the seam and the stem would result in leakage of the cosmetic into the stem compartment of the plastic bag, a more secure and lasting construction has proven practical in further development of the invention, in which the plastic bag is compressed by a clamping means all around the front rim of the stripper while closing off the capsule from the stem compartment. The conventional tip of the stripper, which tapers toward the stem and holds it constrictively, thus virtually forms the sealing wall, and it matters not whether this part of the stripper is smeared with the cosmetic substance. The cylindrical portion that usually follows, on whose front rim the clamping means in accordance with the invention is to sealingly compress the bag, offers sufficient manipulation space to assure that, after the clamping means is opened and the plastic bag is torn open, it will be possible to obtain a clean grip on this unsoiled cylindrical section of the stripper so that it can be operated without soiling the hands.

To special advantage the clamping means can be a clip with snap fastening elements which is comprised of two halves, and it has furthermore proven to be advantageous for the clip parts to be in the shape of an uppercase omega with laterally projecting serifs on which the snap fastening elements can be formed.

To prevent the clip from shifting on the stripper and to improve the sealing action, provision can furthermore be made for the clip to be provided with a groove accommodating a circumferential marginal holding bead; of course, the groove and bead could also be disposed in reverse order on the two components.

The handling of the clip can lastly also be simplified by joining the clip halves together with a film hinge.

Finally, it is also in the scope of the invention that other kinds of clamping means can be provided instead of clips, such as a rubber ring, for example, or an adhesive tape wound tightly during manufacture around the stem section (with or without a stripper interposed), or the like.

Additional advantages, features and details of the invention will be found in the following description of two embodiments in conjunction with the accompanying drawing wherein:

DESCRIPTION OF THE PREFERRED EMBODIMENTS

Figure 1:
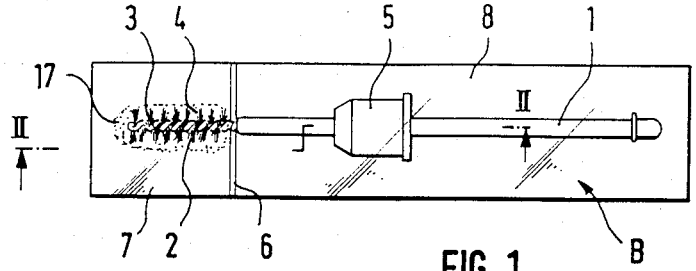
FIG. 1 is a view of a first embodiment of a disposable mascara tester in accordance with the invention.
Figure 2:
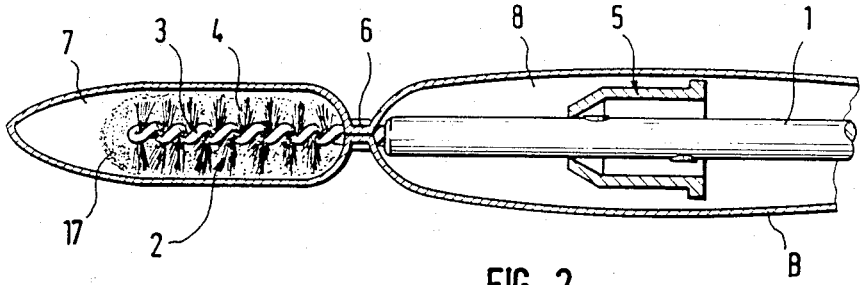
FIG. 2 is an enlarged fragmentary cross section taken along line II—II in FIG. 1.

The disposable mascara tester in accordance with the invention, represented in FIGS. 1 and 2, consists of an applicator unit in the form of an elongated stem 1 with an applicator 2—in the present case a mascara brush with bristles 4 held in a twisted wire core 3—disposed at its front end. A conventional stripper 5, such as is normally built into the containers of cosmetic units rides on the stem 1 in order to strip off the excess cosmetic whenever the applicator is withdrawn. This applicator unit is heat-sealed in a transparent plastic bag B, which contains an additional cross seam 6 running transversely over the stem 1 or wire core 3, sealing a front capsule 7 from the rear stem compartment 8. This reservoir chamber 7 is at least partially filled with a cosmetic substance, in sufficient quantity for a single test of the substance by a user. In FIGS. 1 and 2 this reservoir chamber is indicated by the broken line 17 which surrounds the actual applicator. In the case of cosmetics in powder or liquid form, this kind of local placement of the cosmetic substance around the applicator in the reservoir chamber 7 will not, of course, be present. The cross seam 6 does not, of course, have to be laid over the wire core of the applicator as represented, but could also run directly over the stem 1. If it is technically possible and the cross seam can be placed over the substantially thinner wire core 3 directly ahead of the beginning of the stem 1, this will have the advantage of also achieving an additional sealing of the front end of the stem 1.

Figure 3:
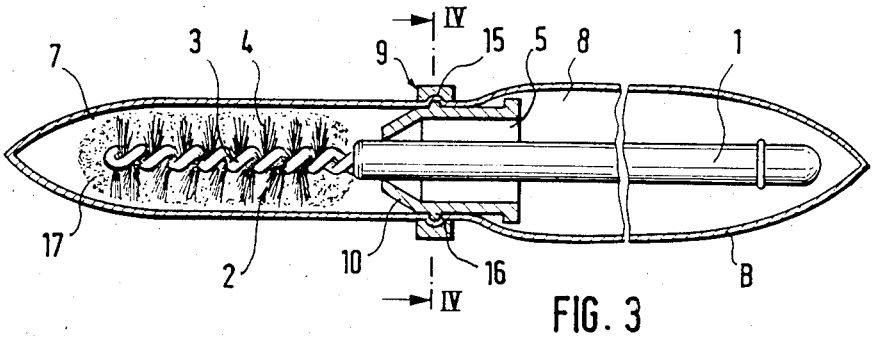
FIG. 3 is a shortened side view of a variant disposable mascara tester with a different method of sealing the capsule from the stem compartment.
Figure 4:
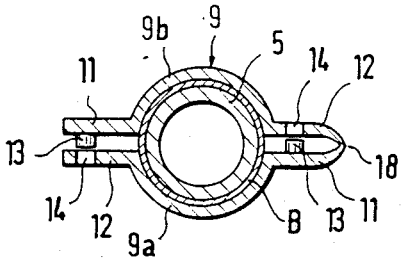
FIG. 4 is a section through the seal taken along line IV—IV in FIG. 3.

FIGS. 3 and 4 show a slightly more complex design of a disposable mascara tester, but one in which the sealing effect is still more secure.

In this case, only the manner in which the reservoir chamber 7 is sealed from the stem chamber 8 is different from the design in FIG. 1, while the applicator unit as such can be made entirely the same as in the embodiment shown in FIGS. 1 and 2. Instead of the seam 6 in the first embodiment, in the embodiment shown in FIGS. 3 and 4 the transparent plastic bag B is pressed sealingly by a circumferential clip 9 against the front edge of the stripper 5, so that the applicator in conjunction with the circumferential clip constitutes the wall sealing off the reservoir chamber 7. Between stem 1 and the edge of the tapered tip 10 of the stripper 5 in contact with it, the cosmetic agent cannot pass, and externally it is prevented from leaving the reservoir chamber by the sealingly compressed edge of the bag.

The clip 9 consists of two parts 9*a* and 9*b* each largely in the shape of an upper-case omega, which are held together at one end by a film hinge 18 and can be fastened together by snap-fastening means. In the latter case a stud 13 is provided on one lateral foot 11 of each of the clip halves, and a hole 14 is provided on each of the other lateral feet of the omega-shaped clip halves, resulting in a snap fastening. On the inside of the clip halves, in the semicircular portion in which the plastic bag B is to be pressed against the stripper, a circumferential groove 15 is provided which accommodates a circumferential holding bead 16 on the stripper 5 and thereby both enhances the sealing action and prevents the clip from shifting with respect to the stripper and causing the seal of the reservoir chamber 7 to leak.

I claim:

1. A disposable mascara tester for the hygienic testing of cosmetic materials comprising a stem mean, an applicattor attached to said stem means, a stripper means on said stem means operable to strip excess of said cosmetic materials from said applicator, a plastic covering disposed about said stem means, said stripper means and said applicator, said plastic covering being sealed to thereby define a sealed capsule in which said stem means, said stripper means and said applicator are encapsulated, and a sample of cosmetic material within said sealed capsule, said plastic covering having a reservoir chamber and a stem chamber, and clamping means clamping a portion of said plastic cover onto said stripper means, said clamped portion of said plastic cover dividing said plastic cover into said reservoir and said stem chambers, said applicator being operable to effect application of said sample of cosmetic material upon unsealing said plastic covering.

2. A disposable mascara tester according to claim 1, wherein said stripper means has a circular configuration, and said clamping means presses said portion of said plastic cover circumferentially about said stripper means.

3. A disposable mascara tester according to claim 1, wherein said clamping means comprises two semi-circular parts, and fastening means fastening said two semi-circular parts together.

4. A disposable mascara tester according to claim 3, wherein said fastening means comprises a projection on one of said semi-circular parts and an opening in the other of said semi-circular parts, said opening receiving said projection with an interference fit.

5. A disposable mascara tester according to claim 3, wherein each of said semi-circular parts comprises a semi-circular mid-section and two lateral end flange sections, each said semi-circular mid-sections having a center, said two lateral end flanges being parallel to a diametrical plane passing through center.

6. A disposable mascara tester according to claim 3, further comprising connecting means connecting said two semi-circular parts together.

7. A disposable mascara tester according to claim 6, wherein said connecting means comprises an integral connecting between said two semi-circular parts.

8. A disposable mascara tester according to claim 5, wherein one of said lateral end flanges of one of said semi-circular parts is integrally joined to one of said lateral end flanges of the other of said semi-circular parts.

9. A disposable mascara tester according to claim 1, wherein said stripper means has an external circumferential projection, said clamping means having an internal annular groove, said groove receiving said projection with said portion of said plastic covering being disposed between said projection and said groove.

10. A disposable mascara tester according to claim 1, wherein said clamping means is cooperable with said stripper means to seal said reservoir chamber from said stem chamber.

* * * * *